US011317194B2

(12) United States Patent
Lai

(10) Patent No.: US 11,317,194 B2
(45) Date of Patent: Apr. 26, 2022

(54) SPEAKER

(71) Applicant: MERRY ELECTRONICS (SHENZHEN) CO., LTD., Guangdong (CN)

(72) Inventor: Tsai-Ti Lai, Taichung (TW)

(73) Assignee: MERRY ELECTRONICS (SHENZHEN) CO., LTD., Guangdong (CN)

( * ) Notice: Subject to any disclaimer, the term of this patent is extended or adjusted under 35 U.S.C. 154(b) by 0 days.

(21) Appl. No.: 17/013,836

(22) Filed: Sep. 7, 2020

(65) Prior Publication Data

US 2021/0400377 A1 Dec. 23, 2021

(30) Foreign Application Priority Data

Jun. 22, 2020 (TW) ..... 109121200

(51) Int. Cl.
*H04R 1/28* (2006.01)
*H04R 1/10* (2006.01)

(52) U.S. Cl.
CPC ..... *H04R 1/2803* (2013.01); *H04R 1/1008* (2013.01); *H04R 1/1016* (2013.01); *H04R 1/2811* (2013.01); *H04R 1/2826* (2013.01); *H04R 1/2888* (2013.01); *H04R 2400/11* (2013.01)

(58) Field of Classification Search
CPC ..... H04R 1/025; H04R 1/008; H04R 1/016; H04R 1/2803; H04R 1/2807; H04R 1/2811; H04R 1/2819; H04R 1/2826; H04R 1/2888; H04R 2400/11
See application file for complete search history.

(56) References Cited

U.S. PATENT DOCUMENTS 4,239,945 A * 12/1980 Atoji ..... H04R 1/2819 381/349
4,742,887 A * 5/1988 Yamagishi ..... H04R 1/22 181/129
5,327,507 A * 7/1994 Suzuki ..... H04R 1/1016 381/345
5,790,679 A * 8/1998 Hawker ..... H04M 1/0202 379/388.02
2017/0006373 A1* 1/2017 Bruss ..... H04R 1/2826

* cited by examiner

*Primary Examiner* — Huyen D Le
(74) *Attorney, Agent, or Firm* — CKC & Partners Co., LLC

(57) ABSTRACT

A speaker includes a frame and a partition wall coupled with the frame to form a boundary between an inner chamber and an outer chamber. The frame has an annular sidewall and a top wall. The annular sidewall has a plurality of through holes allowing the inner chamber and the outer chamber in fluid communication.

10 Claims, 4 Drawing Sheets

SPEAKER

CROSS-REFERENCE TO RELATED APPLICATION

This application claims priority to Taiwan Application Serial Number 109121200, filed Jun. 22, 2020 which is herein incorporated by reference.

BACKGROUND

Field of Invention

The present disclosure relates to a speaker, and more particularly, to a speaker equipped with a high-pitched sound zone and a low-pitched sound zone.

Description of Related Art

Listening to music has become an indispensable part of modern life to regulate tension and monotony. Therefore, the sound quality of music produced by the speakers (such as speakers, headphones, etc.) of general consumer products and the experience of using the speaker to listening to music will affect consumption. As consumer demands for sound quality are also higher and higher, the requirements for speakers of general consumer products are increasingly taken care so as to improve the sound quality and the consumer experience.

Generally speaking, a speaker with a small volume, such as an earphone, is capable of accommodating single one sound-producing unit, which is difficult to simultaneously consider the sound experience of high-pitched and low-pitched sound. How to improve the output quality of high-pitched and low-pitched sound in smaller speakers is one of the focusing researches developed by speaker manufacturers.

SUMMARY

In one or more embodiments, a speaker includes a frame and a partition wall coupled with the frame to form a boundary between an inner chamber and an outer chamber. The frame has an annular sidewall and a top wall. The annular sidewall has through holes.

In one or more embodiments, the through holes are not present on the top wall of the frame.

In one or more embodiments, the frame has an opening configured to accommodate an electromagnetic component, and the partition wall covers the electromagnetic component and the opening.

In one or more embodiments, the inner chamber has a hollow chamber defined between the partition wall and the electromagnetic component.

In one or more embodiments, the electromagnetic component has a central hole.

In one or more embodiments, the speaker further includes a porous sound-absorbing body located within the central hole.

In one or more embodiments, the partition wall and the frame jointly form a unitary-piece component.

In one or more embodiments, the speaker further includes a diaphragm coupled to a bottom of the frame.

In one or more embodiments, the diaphragm, the frame and the partition wall collectively define the inner chamber.

In one or more embodiments, the inner chamber fluidly communicates with the outer chamber via the through holes of the annular sidewall.

In one or more embodiments, the speaker further includes a plurality of bass sound adjustment sheets, and each bass sound adjustment sheet covers a corresponding one of the through holes.

In one or more embodiments, the speaker further includes an arc-shaped bass sound adjustment sheet to cover all of the through holes.

In sum, the speaker structure disclosed herein utilizes its partition wall and frame structure to form a boundary between the inner chamber and the outer chamber, and the annular sidewall of the frame has through holes as tuning holes. With the design of the frame tuning holes, the low-pitched sounds are guided to the sidewall and directly transmitted to the outer chamber. With the partition wall, the high-pitched sounds are converged to the inner chamber through a central hole channel of the electromagnetic component. Therefore, the high-pitched and low-pitched sound are transmitted towards different directions, thereby avoiding turbid sound quality, and further making the sound quality uniform and stable output.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
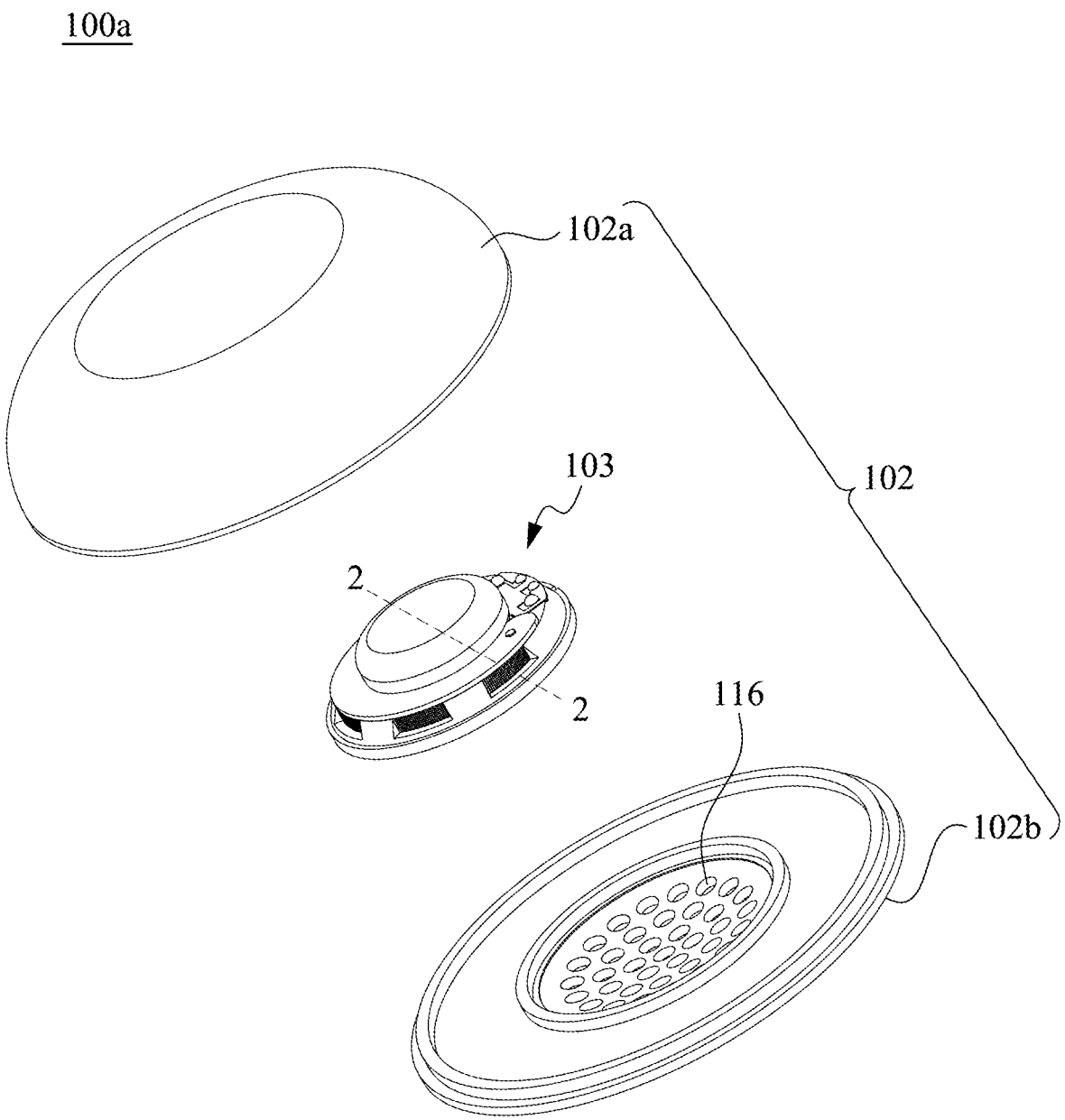
FIG. 1 illustrates an exploded view of a speaker according to one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

Reference is made to FIG. 1, illustrating an exploded view of a speaker according to one embodiment of the present disclosure. A speaker 100*a* includes a sound-producing body 103 and an outer housing 102. The outer housing 102 includes a back cover 102*a* and a front cover 102*b* that are assembled to receive a sound-producing body 103. The sound-producing body 103 produces sounds that are transmitted via output holes 116 of the front cover 102*b*.

Figure 2:
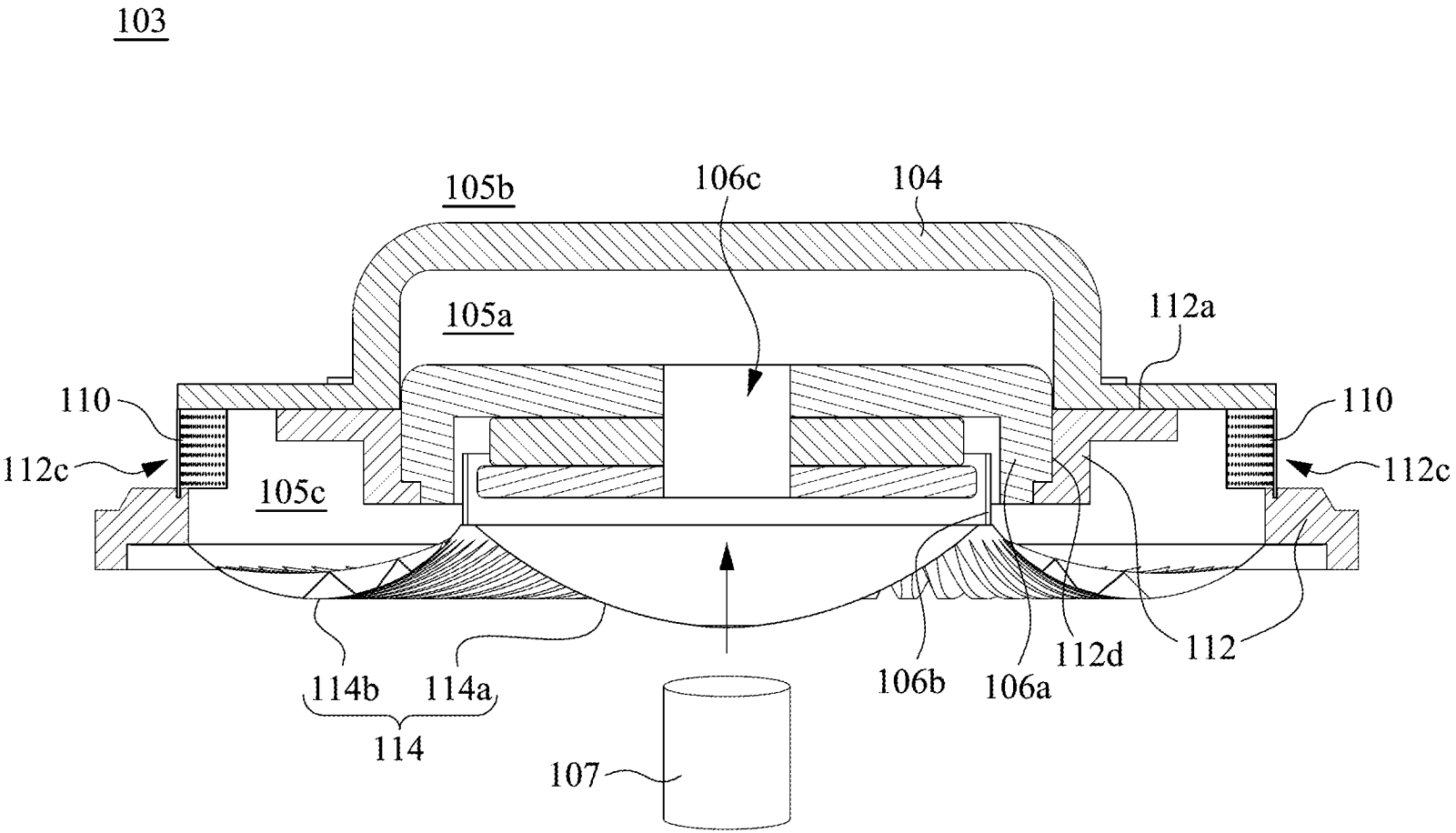
FIG. 2 illustrates a cross-sectional view of a sound-producing unit according to one embodiment of the present disclosure.
Figure 3:
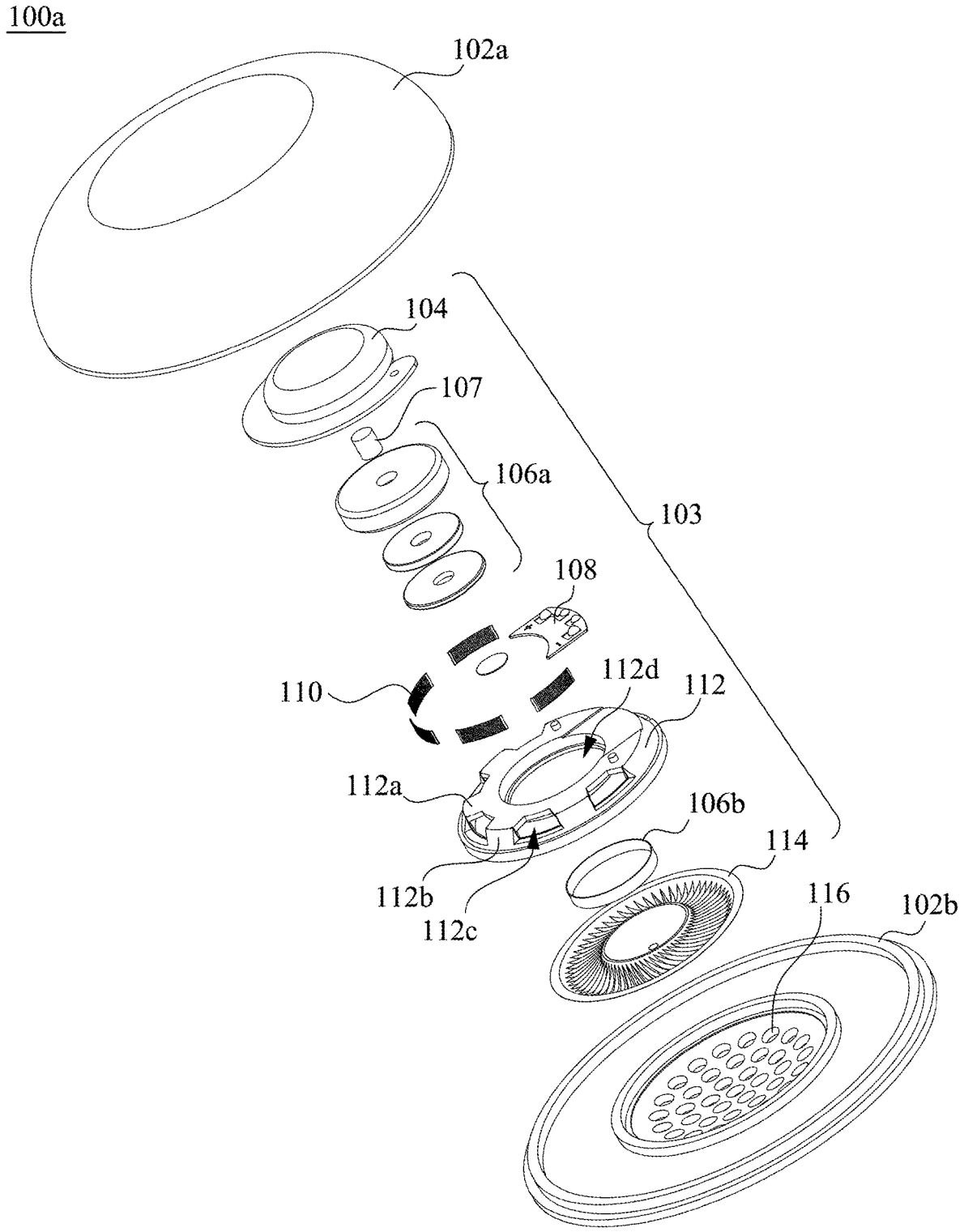
FIG. 3 illustrates an exploded view of a speaker according to another embodiment of the present disclosure.

Reference is made to FIGS. 2 and 3, and FIG. 2 illustrates a cross-sectional view of a sound-producing unit according to one embodiment of the present disclosure. This cross-sectional view is taken along the cross-sectional line 2-2 in FIG. 1. FIG. 3 illustrates an exploded view of the speaker 100*a* in FIGS. 1 and 2. The sound-producing body 103 includes a frame 112 and a partition wall 104. The partition wall 104 is connected to the frame 112, thereby forming a boundary between an inner chamber (105*a*, 105*c*) and an outer chamber 105*b*. The frame 112 has an annular sidewall 112*b* and a top wall 112*a*. The annular sidewall 112*b* includes a plurality of through holes 112*c*, so that the inner chamber (105*a*, 105*c*) and the outer chamber 105*b* are in fluid communication via the through holes 112*c*. After the top wall 112*a* is coupled with the partition wall 104, there is no through hole (present on the top wall 112*a*) allowing the inner chamber (105*a*, 105*c*) and the outer chamber 105*b* in fluid communication.

In this embodiment, the frame 112 has a central opening 112*d* to accommodate an electromagnetic component 106*a*. The partition wall 104 is coupled to the frame 112 to cover the electromagnetic component 106*a* and the opening 112*d*, and forms an inner chamber 105*a* between the partition wall 104 and the electromagnetic component 106*a*.

In this embodiment, the electromagnetic component 106*a* has a central hole 106*c* into which a porous sound-absorbing body 107 can be inserted. In other possible embodiments, the porous sound-absorbing body 107 can also be located in the inner chamber 105*a* such that a virtual volume is created invisibly and the sound resistance is thus adjusted under limited space conditions.

The sound-producing body 103 also includes a diaphragm 114 located at the bottom of the frame 112. The diaphragm 114 includes an inner circle area 114*a* and an outer ring area 114*b*. The position of the inner circle 114*a* of the diaphragm 114 is aligned with the electromagnetic component 106*a*. An inner chamber 105*c* is formed between the outer ring area 114*b* of the diaphragm 114 and the frame 112. In other words, the diaphragm 114, the frame 112, and the partition wall 104 jointly define the inner chambers (105*a* and 105*c*).

The speaker also includes a voice coil 106*b*, which is fixed between the inner circle area 114*a* and the outer ring area 114*b* of the diaphragm 114. The voice coil 106*b* is electrically connected to the driving circuit board 108 that drives the diaphragm 114 to vibrate and generate sounds. The higher frequency sounds generated by the vibration of the inner circle area 114*a* of the diaphragm 114 can be transmitted to the inner chamber 105*a* through the central hole 106*c*. The lower frequency sounds generated by the vibration of the outer ring area 114*b* of the diaphragm 114 can be transmitted to the outer chamber 105*b* (i.e., the cavity area between the partition wall 104 and the outer housing 102) via the inner chamber 105*c* and the through holes 112*c*.

In this embodiment, the speaker further includes a plurality of bass sound adjustment sheets 110, e.g., mesh sheets, and each sheet 110 covers a corresponding through hole 112*c*. The partition wall 104 and the frame 112 are not integrally formed components and need to be bonded by a secondary processing.

Figure 4:
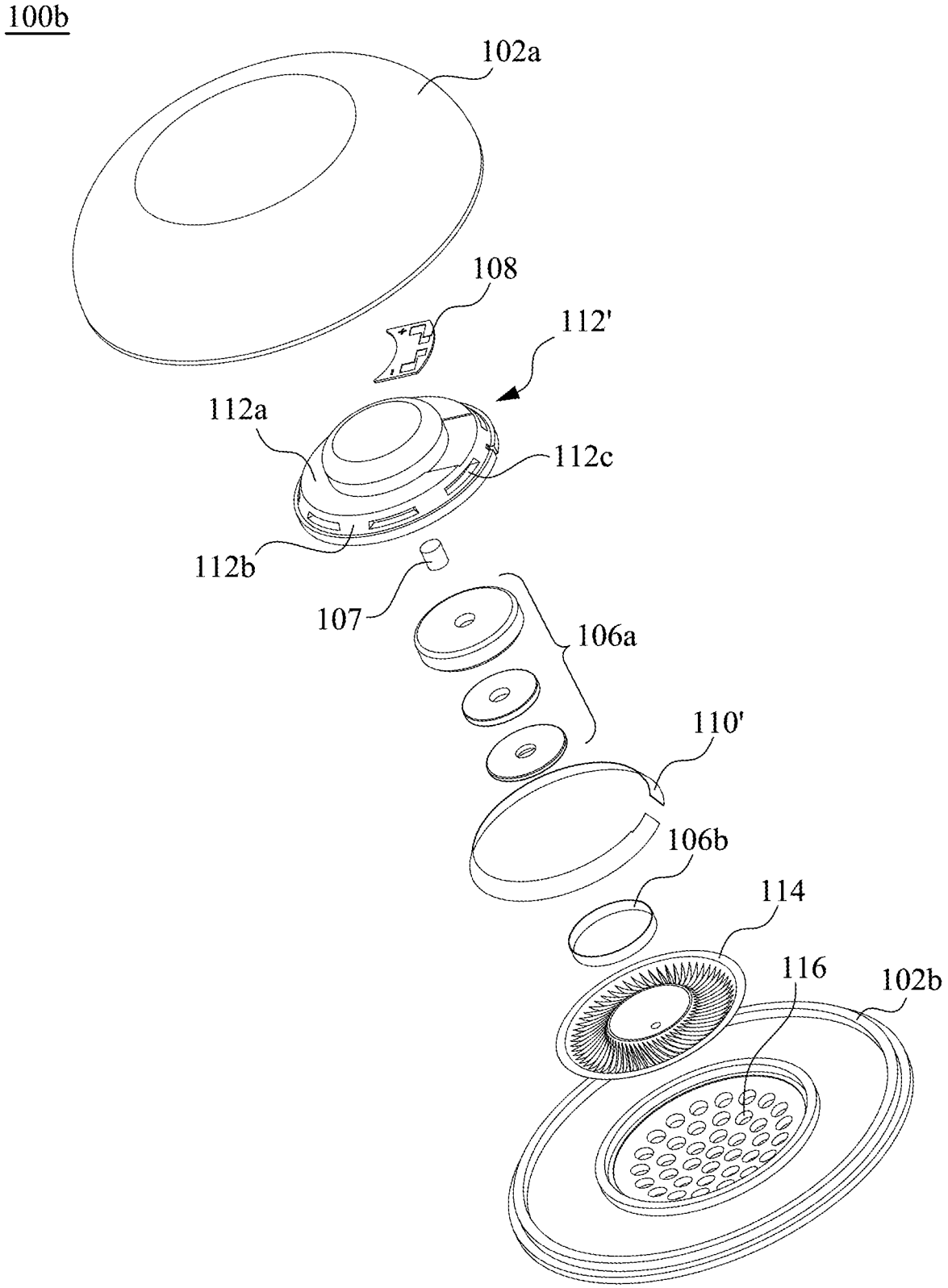
FIG. 4 illustrates an exploded view of a speaker according to still another embodiment of the present disclosure.

Reference is made to FIG. 4, which illustrates an exploded view of a speaker 100*b* according to still another embodiment of the present disclosure. The speaker 100*b* is different from the speaker 100*a* mainly in the structure of the partition wall and the frame. In this embodiment, the partition wall and the frame are integrally formed components (i.e., a frame 112'), and no secondary processing is required for bonding. In addition, the speaker also includes an arc-shaped bass sound adjustment sheet 110', e.g., a mesh sheet, to cover all through holes 112*c* on the side wall of the frame 112'. A top wall of frame 112' does not have a through hole.

In summary, the speaker structure disclosed herein utilizes its partition wall and frame structure to form a boundary between the inner chamber and the outer chamber, and the annular sidewall of the frame has through holes as tuning holes. With the design of the frame tuning holes, the low-pitched sounds are guided to the sidewall and directly transmitted to the outer chamber. With the partition wall, the high-pitched sounds are converged to the inner chamber through a central hole channel of the electromagnetic component. Therefore, the high-pitched and low-pitched sound are transmitted towards different directions, thereby avoiding turbid sound quality, and further making the sound quality uniform and stable output.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A speaker comprising:

a frame having an annular sidewall and a top wall;

an electromagnetic component accommodated within the frame and having a central hole;

a diaphragm coupled to the frame, wherein the diaphragm comprises an inner circle area and an outer ring area; and a partition wall coupled with the frame to form a boundary between an inner chamber and an outer chamber, wherein the annular sidewall comprises through holes, the inner circle area is aligned with the central hole, the outer ring area is aligned with the through holes, wherein an opening of the central hole and an opening of each through hole face in different directions.

2. The speaker of claim 1, wherein the through holes are not present on the top wall of the frame.

3. The speaker of claim 1, wherein the partition wall covers the electromagnetic component.

4. The speaker of claim 3, wherein the inner chamber has a hollow chamber defined between the partition wall and the electromagnetic component.

5. The speaker of claim 1, further comprising a porous sound-absorbing body disposed within the central hole.

6. The speaker of claim 1, wherein the partition wall and the frame jointly form a unitary-piece component.

7. The speaker of claim 1, wherein the diaphragm, the frame and the partition wall collectively define the inner chamber.

8. The speaker of claim 1, wherein the inner chamber fluidly communicates with the outer chamber via the through holes of the annular sidewall.

9. The speaker of claim 1, further comprising a plurality of bass sound adjustment sheets, and each bass sound adjustment sheet covers a corresponding one of the through holes.

10. The speaker of claim 1, further comprising an arc-shaped bass sound adjustment sheet to cover all of the through holes.

* * * * *